United States Patent [19]

Eckhardt et al.

[11] 4,295,076

[45] Oct. 13, 1981

[54] ELECTRIC LAMP WITH CEMENTLESS ATTACHED BASE

[75] Inventors: Fritz Eckhardt, Bolheim; Walter Schönherr, Giengen, both of Fed. Rep. of Germany

[73] Assignee: Patent-Treuhand-Gesellschaft für elektrische Glühlampen m.b.H., Munich, Fed. Rep. of Germany

[21] Appl. No.: 22,371

[22] Filed: Mar. 20, 1979

[30] Foreign Application Priority Data

Apr. 4, 1978 [DE] Fed. Rep. of Germany ..... 2814461

[51] Int. Cl.[3] ..... H01K 1/46

[52] U.S. Cl. ..... 313/223; 313/318; 339/144 R; 339/146

[58] Field of Search ..... 313/318, 222; 339/144 R, 144 T, 146

[56] References Cited

U.S. PATENT DOCUMENTS

| | | | |
|---|---|---|---|
| 1,865,468 | 9/1932 | Gustin | 339/146 |
| 2,119,681 | 6/1938 | McGowan | 339/146 |
| 2,157,051 | 5/1939 | Birdseye | 339/146 |
| 3,739,221 | 6/1973 | De Bleyker et al. | 313/318 |
| 4,119,877 | 10/1978 | Grewe et al. | 313/318 |

*Primary Examiner*—Palmer C. Demeo

*Attorney, Agent, or Firm*—Frishauf, Holtz, Goodman & Woodward

[57] ABSTRACT

To permit insertion of a halogen cycle lamp into a standard bayonet or screw-in socket, the glass press stem of the lamp is connected to a standard base by a resilient spring disk formed with a circumferentially notched or serrated edge fitting into the lamp base, the spring disk being formed with a central opening into which the lamp press stem fits, the press stem having wedge-shaped projections thereon which engage behind tabs projecting from the spring disk. Additional projections may be formed on the lamp for engagement with further tabs on the disk for proper centering of the bulb.

12 Claims, 4 Drawing Figures

ELECTRIC LAMP WITH CEMENTLESS ATTACHED BASE

The present invention relates to electric lamps having a glass bulb which is closed off by a press stem secured to a base without the use of base cement, and more particularly to a halogen cycle lamp which has a standard bayonet-type or screw-type base attached thereto.

BACKGROUND AND PRIOR ART

Lamps having a glass press stem usually were used without a separate base by extending lead pins through the glass stem and utilizing the pins directly for engagement with a holding socket, or so formed that a box-like base was fitted to the glass press stem, the base being connected by a cement with the glass press stem, or by a clamp connection.

The multiplicity of bases which were used are undesirable in lamps since ease of interchange is impeded. Halogen cycle incandescent lamps which, usually, have a glass press stem, are used more widely in many applications, and it is desirable to be able to substitute halogen cycle incandescent lamps in places where previously filamentary incandescent lamps without halogen addition were used, the filamentary lamps being connected by bayonet or screw-type bases to standard matching sockets. Halogen cycle incandescent lamps as currently available therefore can be introduced into circuits with bayonet or screw-in sockets only if an adapter is interposed. Adapters are expensive and a large number of different types have to be stocked by supply houses to be able to match the available halogen lamps to the different sockets which are on the market in which the lamps should be introducible.

THE INVENTION

It is an object to eliminate adapters and to provide halogen incandescent lamps with lamp bases which permit direct insertion of the lamp into standard bayonet or screw-in sockets, without attaching the halogen lamp to the base by means of cement.

Briefly, a disk-shaped element of resilient material formed with an upwardly bent, notched or serrated circumferential edge is secured in a cylindrical base shell by engaging the notched edge with the lamp base shell. The cylindrical resilient disk, in turn, is mechanically engaged with the press stem which is positioned essentially centrally thereof. The lead-in wires extending from the press stem are soldered to the base contacts on the base shell.

In a preferred form, the disk-shaped element is a disk of resilient material formed with a central opening matching approximately the cross-sectional shape of the glass press stem; resilient projections extend into the opening which engage behind wedge-shaped projections formed on the press stem. In accordance with a feature of the invention, and for accurate, resilient positioning of a halogen cycle lamp, the press stem is formed with essentially spherical projections which engage in tabs or other projections formed on the resilient disk and extending into or towards the central opening, the projections on the disk having punch marks, grooves or notches or creases to receive the projections on the glass press stem, thereby improving the centered position thereof. The resilient disk engages the inner circumferential edge of the base shell which is preferably formed with creases or depressions in which the serrated or notched edge of the disk can engage. The shell can, additionally, be formed with inwardly extending depressions, lugs, or the like, to additionally secure the disk in position.

The arrangement effects positive axial positioning of the lamp with respect to the base while securely supporting the lamp within the base. The stability of the resilient disk can be increased by forming the edge only partially with serrations.

In assembly, the press stem is introduced through the opening of the disk until the depending tabs engage behind the wedge-shaped projections of the stem and the bulb of the lamp seats in the opening. The disk is then snapped into the base where it is held by engagement with the serrated or notched edge in the receiving groove or notch therefor just below the upper rim of the base shell.

Drawings, illustrating preferred embodiments, wherein.

Figure 1:
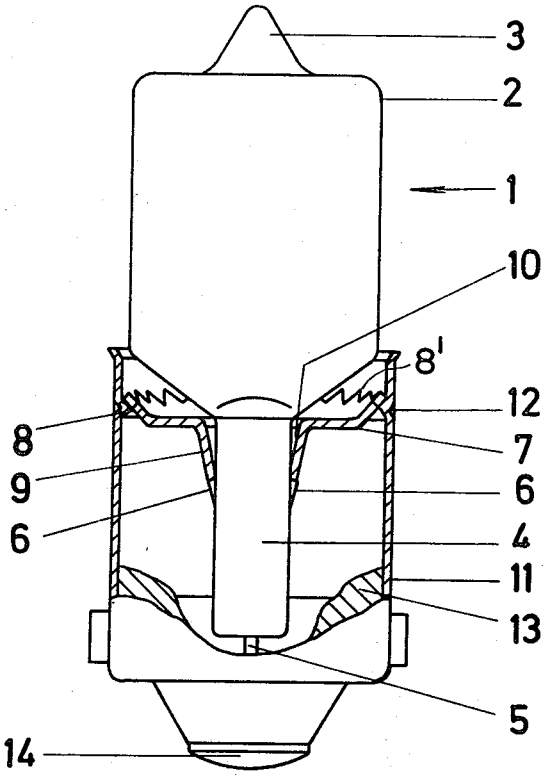
FIG. 1 is a highly schematic longitudinal view of the lamp, with the base partly in section.

The lamp 1 is a halogen incandescent lamp; as shown in FIG. 1, a glass bulb 2 is formed at its external tip end with a melt-off tip 3, and at the other end with a glass press stem 4. Two or more current supply leads 5 are melted into the press stem, for example by the use of melt-in foils or strips. The current supply leads 5 project from the lower portion of the press stem 4. The bulb 2 is filled with an inert gas, for example argon, crypton, or xenon, usually with a slight addition of halogen, or may be evacuated. The press stem 4 has a generally rectangular cross section. A wedge-shaped projection 6 is formed on each of the wider sides. The projections 6 engage with a resilient disk 7 and are used to connect the disk 7 to the stem 4.

The disk 7 is made of metal which is highly resilient, for example steel, bronze, or argentan, i.e. nickel silver. The disk is formed with an upturned serrated or notched edge 8. It has a central opening 10 which matches the cross section of the press stem 4. Resilient tabs 9 extend across the opening 10. Upon pushing the lamp with the press stem through the opening, the tabs 9 engage behind the wedge-shaped projections 6 and secure the bulb to the disk 7. Disk 7, thus attached to the press stem between the bulb 1 and the projections 6, is then introduced into a metal base 11 which may be of brass, steel, or aluminum, or of any other standard base shell or socket material. The base has a generally smooth inside surface, but is formed at the inner circumference thereof with positioning projections 12, such as round or longitudinal, preferably internal creases, cutouts, or punches in order to define the axial position of the disk 7, so that the outer circumference of the disk 7 can engage against the deformation 12, and can seat thereabove. The serrated edge 8 of the disk 7 prevents axial removal once the disk 7 has been pressed into the base shell. As can be seen, the serrated points 8' of the disk 7 will bite into the smooth inside of the base shell 11 if axial forces in the direction counter the insertion direction are applied. The current supply leads 5 of the lamp are carried through the bottom 13 of the base, insulated from each other, and connected to respective base terminals 14 and/or the base 11 itself, as determined by the socket connection specifications. The base 11 can be a bayonet base (FIG. 1) or a screw-in base, as seen at 211 in FIG. 2.

Figure 2:
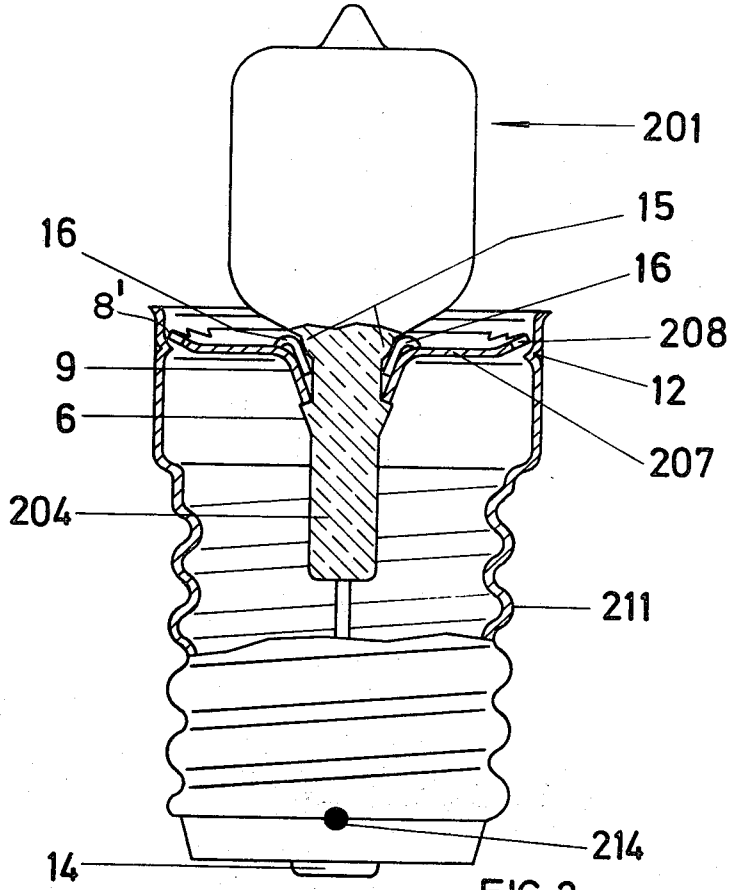
FIG. 2 is a view similar to FIG. 1, to an enlarged scale, and showing modifications.

The lamp of FIG. 2, essentially, is similar to that of FIG. 1. If exact centering of the lamp 1 is additionally deemed desirable, the press stem 204 has locating projections 15 formed thereon; the projections 15 preferably have generally spherical form. The projections 15 engage locating tabs 16 secured to the disk 207. The tabs 16 are preferably formed with receiving deformations which essentially match at least in part the shape of the projections 15 on the stem or on the lamp, for example by being formed as punch marks, creases, notches or grooves or the like.

Figure 3:
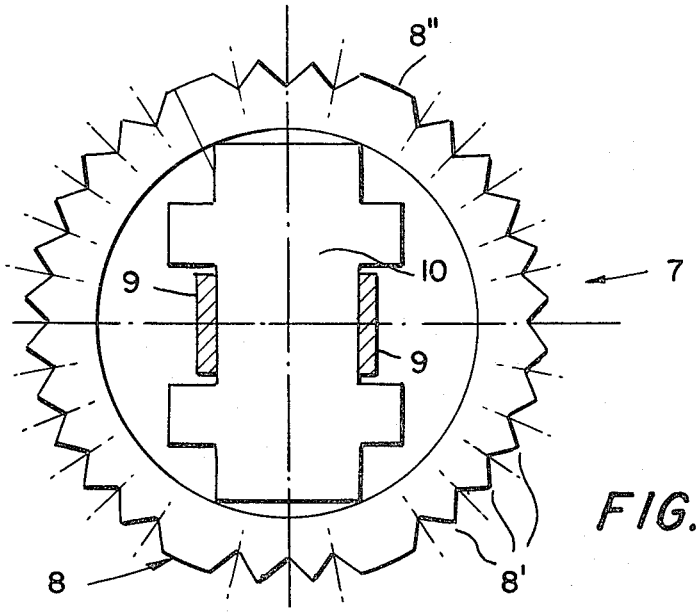
FIG. 3 is a plan bottom view of the disk, partly in section.
Figure 4:
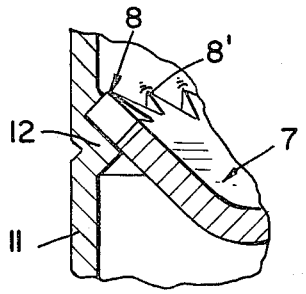
FIG. 4 is a greatly enlarged detailed perspective view showing the seating of the disk against the inside of the base shell.

The stability of the disk 207 can be improved if the upturned edge 208 is only partially serrated as seen at 8'', FIG. 3 or formed with engagement notches.

The term base as used herein is deemed to include not only an insertion base for insertion into a socket, but may further include other shell-like elements, for example a reflector, or the like; thus, the resilient disk 7 can be introduced into a reflector-like shell extending substantially around the lamp bulb 1.

In case of a two-terminal lamp, one connection of the lead wire 5 can extend to terminal 214, the other to terminal 14 at the bottom of the base. The spring disk 7 retains the halogen cycle bulb 2 of the lamp in the socket 11, 211 without cement, use of cement is undesirable, in particular, if application of a halogen cycle lamp in motor vehicle headlights is intended. The usually applied base cement is hygroscopic. The action of moisture and change of temperature can lead to detachment of cement particles. The hygroscopic action of the cement or its detached particles and the penetrated moisture are of detrimental effect upon the reflective coating of the headlight when contacting it. Detachment of the reflective coating can be the result.

We claim:

1. Electric lamp having a bulb (2), a glass press stem (4) projecting from the bulb, and lead wires (5) projecting from the stem in combination with a cylindrical lamp base shell (11) open at one end for insertion of the press stem and having internally projecting locating means (12) and a generally smooth interior surface in the region between the open end and said locating means; and means securing the bulb (2) to the lamp base shell (11) comprising;

a resilient disk-shaped element (7) formed with an upwardly bent notched or serrated edge (8) having serration points (8'), the points (8') of the notched or serrated edge being engaged against the generally smooth interior surface of the lamp base shell;

the disk-shaped element mechanically engaging the press stem essentially centrally of the disk-shaped element, said lead wires being soldered to base contacts (14, 214) on the base shell.

2. Lamp according to claim 1, wherein the base shell (11) is a metal shell of a metal which permits said serration points (8') to engaage thereagainst and prevent removal of the disk-shaped element (7) and the press stem therein from the base shell upon application of force in the direction of the upward bend.

3. Lamp according to claim 1 or 2, wherein the resilient disk-shaped element comprises a metal disk having good spring or resilient characteristics.

4. Lamp according to claim 1, wherein the resilient disk-like element (7) is formed with a central opening (10) corresponding in cross section approximately to the cross section of the glass press stem (4);

resilient tabs (9) extending from the disk-shaped element; and wedge-shaped projections (6) formed on the press stem and positioned for engagement of the tabs (9) projecting from the press stem therebehind after insertion of the press stem through said opening to hold the press stem in position in the resilient disk with the bulb (2) positioned against the disk at the side thereof opposite the side from which the tabs project.

5. Lamp according to claim 1, further including projections (15) formed on the lamp press stem (4) integrally therewith and adjacent the bulb (2), and tabs (16) extending from said disk-like element (7) formed to have at least in part a contour matching that of the projections.

6. Lamp according to claim 5, wherein the projections are generally part-spherical and the tabs receiving the part-spherical projections are formed with grooves, punch marks or creases, and positioned to center the bulk (2) with respect to the disk (7).

7. Lamp as claimed in claim 1 wherein the lamp is a halogen cycle incandescent lamp;

the lamp base (11) is cylindrical;

the resilient disk-shaped element (7) comprises an essentially circular metal disk having good spring or resilient characteristics;

the resilient disk-like element (7) is formed with a central opening (10) corresponding in cross section approximately to the cross section of the glass press stem (4);

resilient tabs (9) are provided extending from the disk-shaped element;

wedge-shaped projections (6) are provided formed on the press stem and positioned for engagement of the tabs (9) projecting from the press stem therebehind after insertion of the press stem through said opening to hold the press stem in position in the resilient disk with the bulb (2) secured therein being positioned against the disk at the side thereof opposite the side from which the tabs project;

the locating means comprise a deformation formed in the base shell (11, 211) located adjacent the opening thereof to define a seating ridge (12) positioned at least in part along the circumference of the base and to determine the axial insertion position of the disk-like element (7) within the base shell; and wherein the cylindrical lamp base comprises a metal base having at least one of the connection terminals at the bottom thereof.

8. Lamp according to claim 7, further including locating projections (15) formed on the lamp press stem (4) integrally therewith and immediately adjacent the bulb (2), and locating tabs (16) extending from said disklike element (7) formed to have at least in part a contour matching that of the projections.

9. Lamp as claimed in claim 7, wherein the base comprises a bayonet-type base to be received in a standard bayonet-type socket.

10. Lamp as claimed in claim 7, wherein the base comprises a metal screw-in base to be received in a standard metal screw-in type socket.

11. Lamp according to claim 1 wherein said disk shaped element (7) is of highly resilient material, and said metal shell base (11) comprises at least one of the materials of the group consisting of: brass; aluminum.

12. Lamp according to claim 11 wherein said resilient disk shaped element is made of a material of the group consisting of at least one of steel, bronze, nickel-silver.

* * * * *